United States Patent [19]

Schuerch

[11] Patent Number: 4,534,163

[45] Date of Patent: Aug. 13, 1985

[54] ROPE OR CABLE AND METHOD OF MAKING SAME

[75] Inventor: Peter E. Schuerch, Windham, N.H.

[73] Assignee: New England Ropes, Inc., New Bedford, Mass.

[21] Appl. No.: 533,154

[22] Filed: Sep. 19, 1983

[51] Int. Cl.[3] ..... D07B 1/04; D07B 7/14

[52] U.S. Cl. ..... 57/233; 57/7; 57/32; 57/234; 57/295; 57/297; 87/6

[58] Field of Search ..... 57/3, 6, 7, 9, 13, 15, 57/31, 32, 210, 225, 232–235, 250, 251, 258, 260, 295, 297, 309; 87/6

[56] References Cited

U.S. PATENT DOCUMENTS

| | | | |
|---|---|---|---|
| 3,418,799 | 12/1968 | Catlos | 57/235 |
| 3,446,002 | 5/1969 | Kippan | 57/234 |
| 3,485,135 | 12/1969 | Germain | 87/6 |
| 3,627,572 | 12/1971 | Barnett | 57/233 X |
| 3,960,050 | 6/1976 | Eisler | 57/7 X |
| 4,019,940 | 4/1977 | Hood | 87/8 X |
| 4,275,117 | 6/1981 | Crandall | 57/251 X |
| 4,312,260 | 1/1982 | Morieras | 57/234 X |
| 4,321,854 | 3/1982 | Foote et al. | 87/6 |

*Primary Examiner*—Donald Watkins

*Attorney, Agent, or Firm*—Salter & Michaelson

[57] ABSTRACT

In making synthetic rope or cable, a plurality of filaments are brought in parallelism into a core and compacted by a plurality of ribbons or tapes wound about the core under tension in opposite directions to form a uniform jacket that is torsionally stable. An outer sheath which may be urethane or other plastic material is applied to the jacket under sufficient pressure to penetrate the jacket but not the core, and then the urethane is cured. The rope or cable of the invention has a core of substantially parallel filaments free to move within the jacket of ribbons wound about the core and penetrated with the urethane or other plastic material. The method affords many advantages in speed of manufacture and cost, and provides a rope or cable of greater tensile strength and flexibility than other rope or cable constructions.

28 Claims, 7 Drawing Figures

ROPE OR CABLE AND METHOD OF MAKING SAME

BACKGROUND OF THE INVENTION

The present invention relates to a novel rope or cable construction and the method of making same. Although the making of rope or cable is an ancient art, modern materials and methods have improved the art substantially. The following U.S. patents and what they describe are illustrative of the background for the present invention and represent the closest prior art of which applicant is aware:

Buhler U.S. Pat. No. 2,107,567 dated Nov. 23, 1934, for Finishing Welt. A decorative rope formed of a central core, twisted or straight, and a cover, woven or braided.

Thompson U.S. Pat. No. 2,146,275, dated Feb. 7, 1939, for Impregnated Woven Sheath. A core of parallel yarns is bonded at intervals, and a nonporous layer around the core and an outer coating of neoprene are formed to prevent the instrusion of moisture.

Buhler U.S. Pat. No. 2,360,106, dated Oct. 10, 1944, for Joint Packing. A rope with a resilient core is bound in a woven or braided cover and used for packing.

Poirier et al. U.S. Pat. No. 2,737,075, dated Mar. 6, 1956, for Cord Structure. A plurality of casings are successively braided over the core and applied loosely to permit slipping and thus allow flexing of the cord.

Creve U.S. Pat. No. 2,985,056, dated May 23, 1961, for Line and Method of Manufacture Thereof. A core of animal fibers and synthetic fibers are twisted together, moistened to bind them and provide high tensile strength, and then covered with strands of braided synthetic fibers to form a string for a tennis racquet or the like. The strands and core are bonded by a synthetic material which dries hard. The braided cover is for the purpose of good wear.

Morieras U.S. Pat. No. 3,265,809, dated Aug. 9, 1966, for Cables with Bonded Organic Filamentary Insulation. A central conductor is surrounded by bonded, parallel twisted yarns of insulating fibers impregnated with latex. Then a sheath is braided about the core. The assembly is sized through a die and oven-cured. The rope is intended to afford good insulating qualities and tensile strength.

Durkee et al. U.S. Pat. No. 3,457,717, dated July 29, 1969, for Plastic Coated Cable and Method of Making Same. Strands of wire are aligned in several cables, bundled into a larger cable, and spaces in the outside of the bundle receive smaller cables to tend to fill in and smooth the outer periphery. Molded plastic strips with butt or lap joints fill the outer interstices. Caulking of a soft plastic material is then applied. A thin binder of glass adhesive tape holds the strips in position, and then a spiral wrap of nylon or other plastic is followed by a layer of acrylic resin which is then cured. This cable is intended for suspension-bridge cabling, the outer cover providing a moisture barrier.

Hood U.S. Pat. No. 3,911,785, dated Oct. 14, 1975, for Parallel Yarn Rope, and Hood divisional U.S. Pat. No. 4,019,940, date Apr. 26, 1977, for Method of Manufacturing Parallel Yarn Rope. A plurality of slightly twisted filaments are paralleled together and bonded by a binder disposed predominantly on the surface of the yarns to form a core. A nonporous layer of flexible, water-impervious insulating material surrounds the core. A jacket is braided over the insulating material, and a final costing of neoprene completes the rope. Applying the binder only on the surface of the yarns is intended to aid flexibility; the rope is intended to have good insulation qualities.

Phillips U.S. Pat. No. 3,936,336, dated Feb. 3, 1976, for Method of Forming Reinforced Plastic Articles Utilizing Openwork Tubes. A glass fiber tube, such as a braided covering, is charged with a core of resin-impregnated fibers. The tube is tensed to reduce the tube diameter, impregnate the core, and cover with excess resin. Then the resin is cured to produce a strong rod of reinforced plastic and may be tensed when bent to provide a curved-shaped article.

Morieras U.S. Pat. No. 4,312,260, dated Jan. 26, 1982, for Flexible Cable. A core is formed of a bundle of parallel threads. The threads are impregnated at spaced intervals at a nonperpendicular angle to the axis of the parallel fibers, thus systematically mixing the overlaps, that is, mixing systematically the impregnated, inflexible portions and the nonimpregnated, flexible portions of the core. The core is surrounded by a bonded outer layer over which a cover is braided. The spacing between the impregnated portions is to afford some flexibility to the final product, whereas the impregnated portions are intended to give tensile strength.

Also of interest are Kippen U.S. Pat. No. 3,415,919 dated Dec. 10, 1968; 3,446,002 dated May 27, 1969; and 3,551,280 dated Dec. 29, 1970; which show twines having a core comprising a bundle of untwisted monofilaments with a wrap or casing applied to the core to complete the twine.

SUMMARY OF THE INVENTION

A plurality of parallel filaments are aligned and compacted to form a core. The core is then wrapped to form a uniform jacket that is torsionally stable. Urethane or other plastic material is applied to the jacket to penetrate the wrapping without penetrating the core. Then the urethane or other material is cured. The rope or cable thus has a core of parallel filaments free to move within the urethane jacket. In some cases, an outer sheath, such as a braided sheath, may be used, with or without the urethane impregnation.

DESCRIPTION OF THE DRAWING

The various objects, advantages, and novel features of the invention will be more fully apparent from the following detailed description when read in connection with the accompanying drawing in which like reference numerals refer to like parts and in which.

DESCRIPTION OF THE INVENTION

Figure 1:
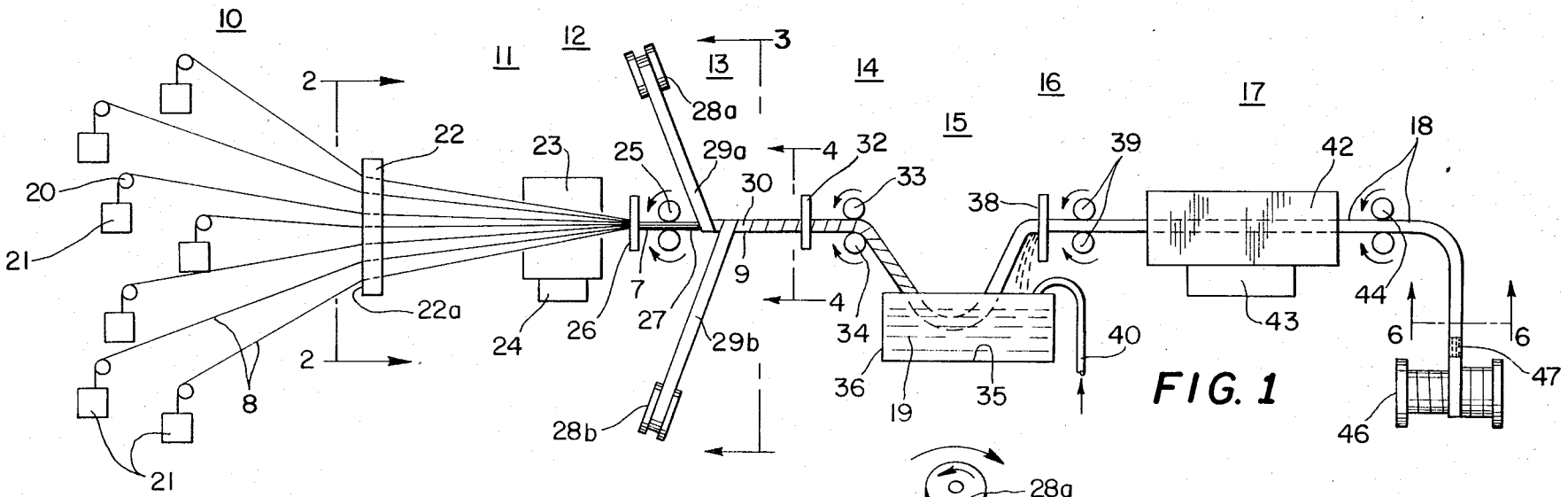
FIG. 1 is a highly schematic representation illustrating a method embodying the invention to make a rope of the invention.
Figure 2:
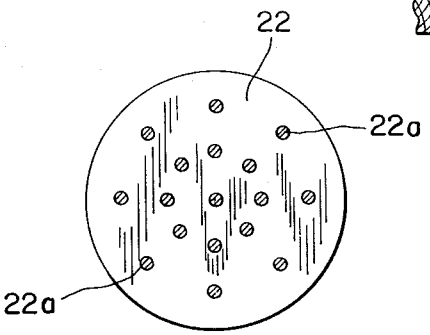
FIG. 2 is an enlarged schematic sectional view along lines 2—2 of FIG. 1 showing bundles of fibers being positioned by a registration plate in preparation for a core of the rope or cable being manufactured.

Referring to FIG. 1, a plurality of filaments 8 are organized into a group of parallel, preferably untwisted, filaments in a zone 10, dried in a zone 11, compacted into a core 7 in a zone 12, wrapped with ribbon to form a jacket 9 in a zone 13, and further compressed or compacted in a zone 14. Then a plastic material 19, such as urethane, is applied in a zone 15 and the material 19 compressed into the wraps of jacket 9 in a zone 16 to penetrate the wraps only and not the filaments 8, which are left free to move relative to each other. Finally the urethane or other material 19 which penetrated the jacket 9 is cured in a zone 17 to provide a completed rope or cable 18. In the organizing zone 10, filaments 8 are drawn from supply source 21 and thence through apertures 22*a* of a registration plate 22 (FIG. 2, not to scale). The registration plate 22 is only schematically indicated. The number of apertures 22*a* may be much greater than the number shown and symmetrically arranged about an axis to align the filaments 8 into substantial parallelism.

Each supply source 21 may feed a non-twisted yarn with many filaments 8, and each aperture may pass a like plurality of filaments 8 from the source 21. After leaving the plate 22, the filaments 8 advance into a drying zone 11 where they pass through a drying chamber 23 heated by any suitable heat source 24.

After drying, the filaments 8 are compacted by a die 26. Means, such as a pair of rollers 25, the drive means for which is not shown, serve to draw the core 7 of the filaments 8, now compacted into compressed core 27, through the die 26, and also serve to draw the filaments 8 from the supply source 21 over the tensioning devices 20 and through the plate 22.

Figure 3:
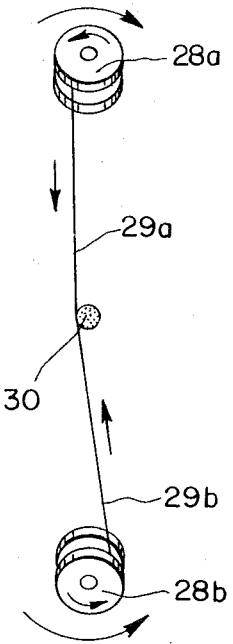
FIG. 3 is a sectional view along lines 3—3, not to scale, of FIG. 1 showing one method of wrapping the core.

The compacted core 27 of filaments 8 is now wrapped in a zone 13 to provide the jacket 9. In this exemplification, the jacket 9 is applied by winding or twisting around the compacted core 27 from respective spools 28*a* and 28*b* narrow ribbons or tapes 29*a* and 29*b* in opposite directions (see arrows, FIG. 3) so the parallel filaments 8 are not inadvertently or undesirably twisted. The tension for each spool may be controlled by means of a friction release (not shown) applied to the respective spools 28*a* and 28*b*. The higher the friction, the more force is required to draw the ribbon from the spools 28*a*, 28*b*; and the greater the tension as the ribbons 29*a* and 29*b* are wound upon the core, the more tightly the core is compressed at this stage. Mechanisms for such wraps are known, and that of FIGS. 1 and 3 is only schematically illustrated.

Preferably the ribbons 29*a*, and 29*b* are ribbons of absorbent material so that the later-applied urethane 19 may readily impregnate the ribbon, but not penetrate into the core. Also, more than the two layers of ribbons 29*a* and 29*b* may be applied if desired, i.e., there may be more than two spools used at a time; but preferably an even number to avoid accumulating a twist in the filaments being wrapped. Although a knitted fabric is preferred for the ribbon, other ribbons, such as those of woven or nonwoven fabrics or synthetics films, may also be used. For simplicity, speed of application, and low cost, I prefer to use ribbons of narrow polyester knit fabric, and helically wrapped in opposite hand about the core. The degree of overlap of the ribbons may also be controlled to provide a desired number of layers at a point along the axis. Although it has been found preferable to wrap the core with a like number of ribbons in each direction, it is possible to provide an effective wrap comprising one or more ribbons spirally wound around the core in the same direction, so long as the core is completely covered by the wrap.

The rope or cable 30 comprising the compacted core 27 of filaments 8 and the wrap 29*a*, 29*b* now passes into zone 14 for further compacting to a specified size by passage through a die 32. The rope 30 is drawn from the rollers 25 and past the wrapping zone 13, and thence through the die 32 by means such as rollers 33 and 34, the drive means for which is not shown.

From compacting zone 14 the rope or cable 30 enters at zone 15 a urethane or other material bath 35 in a tank 36 which may be replenished as needed from a pipe 40. The material may also be extruded directly onto the rope or cable.

The rope, coated with such urethane or other material, is fed through a die 38 in a zone 16. The die forces the urethane or other material to impregnate jacket 9 of the rope. At the same time, the excess coating is wiped off and returns to the bath 35. The die 38 aperture is selected to force impregnation of only the jacket 9 with urethane or other material, and not to have urethane or other material penetrate the core or inner bundle of monofilaments 8, which are left free.

Preferably the filaments 8 are not penetrated at all, or, at the very least, only the very outermost ones of the bundle. On the other hand, it is not essential to completely impregnate all the layers of the ribbon to its complete depth. I prefer to have the urethane penetrate substantially completely the layers of ribbon, and not at all the filaments 8. The impregnated rope is pulled through the die 38 by means such as rollers 39, the drive means for which is not shown. A layer of urethane 19 may be left on the outer surface of the rope or cable for abrasion-resistance and moisture-barrier purposes.

Figure 6:
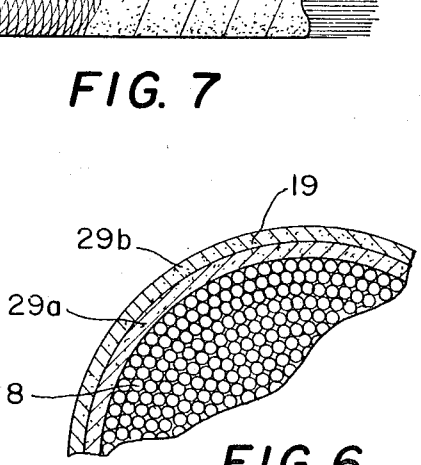
FIG. 6 is a fragmentary enlarged sectional view along lines 6—6 of FIG. 1 illustrating the appearance of the finished urethane impregnated rope or cable made by the method of the instant invention.
Figure 4:
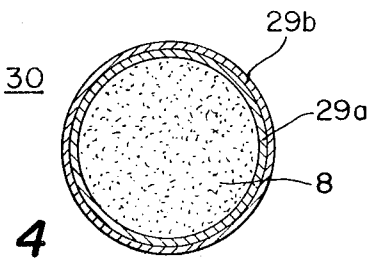
FIG. 4 is an enlarged sectional view along lines 4—4 of FIG. 1 illustrating the inner appearance of a wrapped core before curing.

Then the rope or cable is advanced into a curing or heating zone 17 where it is cure—for example, in an oven 42 heated by a suitable heat source 43. Means such as a pair of rollers 44 draw the rope through the oven 42 from the rollers 39 and discharges the completed rope 18, which now may be wound onto a suitable spool 46. As it is being wound on the spool 46 or at any convenient time after leaving the curing oven 42, indicia 47 may be marked on the rope so that the length of the rope withdrawn or used may be readily ascertained. In FIG. 6 the finished rope or cable is indicated in cross section, and outer ribbon 29*b* and inner ribbon 29*a* are indicated as penetrated with the cured urethane or other material by stippling. The number of filaments may be in the thousands and are illustrated as in FIG. 4. The filaments are left free; that is, they are non-adhered to each other or to the jacket 9 impregnated with the cured urethane.

Figure 7:
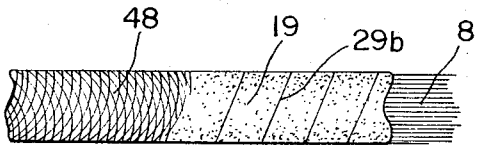
FIG. 7 is an enlarged fragmentary side view of the rope or cable of FIG. 6 with a braided sheath being applied thereover.
Figure 5:
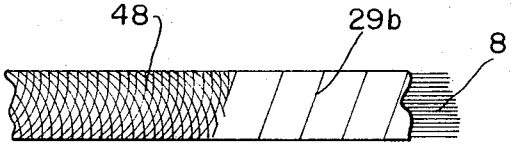
FIG. 5 is an enlarged fragmentary side view of the rope or cable of FIG. 4 with a braided sheath being applied thereover.

It will be understood that while the use of urethane or the like coating is preferred, in some applications it may be desirable to substitute an outer sheath 48 that could be braided, extruded or otherwise applied directly to the jacket 9 as shown in FIG. 5. On the other hand, in some cases it may be desirable to apply such an outer sheath over the jacket 9 after the latter has been impregnated with urethane or the like, as shown in FIG. 7. Furthermore, after the braided sheath 48 has been applied to the rope of either FIG. 5 or FIG. 7, it may in some cases be desirable to impregnate the sheath with urethane or the like, which can be accomplished by any suitable means, such as by passing through another tank similar to that shown at 36 in FIG. 1.

As an example in one successful and preferred embodiment, I provide filaments 8 of polyester, six denier per filament, and there may be about 33,000 filaments 8 in the core. The die 26 opening or aperture is about 0.185 inch diameter. When the ribbons 29*a*, 29*b* are drawn from the spools 28*a*, 28*b*, their tension is about twelve pounds. The angle of wrap is about 35°, and the overlap about 40 percent. Thus, there are about four total number of layers or ribbons at any point along the rope 30. The heat of drying chamber should be gentle, preferably about 200° F., although this is not critical. The opening for the die 32 is about 0.250 inch diameter. The ribbons 29*a* and 29*b* are polyester and are about one inch wide. The temperature of the curing oven is about 200° F. The resultant rope or cable is about 0.250 inch outer diameter, and the wall of the jacket 9 after impregnation and curing is about 0.080 inch in thickness. Rope or cable of other outer dimensions may be made by the process. The urethane-impregnated jacket provides improved abrasion and moisture resistance.

A rope or cable of the invention has many advantages. No heat seal or end taping is required when the rope is cut, because it does not unravel. It may be manufactured to close tolerances; and the rope lends itself to various standard end terminations. For example, an eye may be easily formed at either end of the rope and secured by any desirable means, such as a metal sleeve, or the rope may be spliced.

The rope or cable is excellent for use in construction and placement of concrete revetment mats. It is highly resistant to ultraviolet rays, to most chemicals, and to biological conditions encountered at most deployment sites for that purpose. The rope or cable is also highly useful in conditions where a high dielectric constant is desirable. Also, the rope has high tensile strength. For example, a one-quarter-inch size outer diameter has a tensile strength of 3500 pounds; a 5/16 inch outer diameter size has a tensile strength of 7000 pounds; and a half-inch outer diameter size has a tensile strength of 15,000 pounds. Lengths are easily provided of up to 25,000 feet without a core splice.

Because of the parallel filaments of the core being free, that is, not adhered or bound to each other, the rope or cable has a high flexibility compared to other ropes of like strength. The tightly wound jacket holds the core firmly together under compression, eliminating need for any adhesive bond of the fibers, and eliminates the necessity of braiding a cover over the core, although such a cover may be applied over the wound jacket. The cured urethane or other material cover holds the jacket and core together and allows the rope or cable to be cut without unraveling. No binding, heating or melting is required to prevent unraveling. The cured coating, as noted above, is abrasion resistant and creates a moisture barrier. Unlike ropes not resistant to moisture, the invention may be used with minimal risk of creating a conductive path near high-voltage lines and towers.

Double-braided rope is relatively flexible and strong, but it tends to hold moisture, which tends to make it conductive when wet. There is also an undesirable elongation of double-braided rope under tension. These faults are absent in the rope or cable of the present invention, which is resistant to moisture, is still flexible and strong, and exhibits minimum elongation under tension, primarily because of its non-twisted core.

The method of the present invention can produce rope or cable more rapidly than the prior methods. The rope or cable of the invention can be produced at a rate, for example, of about 40 feet per minute, and if desired at greater speeds, up to about 80 feet per minute, with no spooling or twisting, with only one machine, and with a waste factor about equal to, or even less than, one percent, far better than current speeds and production losses.

By varying the tension of the cover wrap, the size of the compacting die, and the hardness of the urethane or other material, various degrees of flexibility, size and tensile strength can be obtained for the rope or cable of the present invention without the necessity of changing production speeds, machinery, or feed set-ups. These factors contribute to a low production cost and make possible a low price for the rope or cable of the present invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of making rope or cable comprising the steps of:

(a) aligning a multiplicity of filaments in substantially parallel relation to each other and to the rope axis;

(b) compacting said filaments under tension to form a core; and (c) spirally wrapping said core with one or more tapes so as to completely cover said core while at the same time maintaining said core filaments substantially parallel to the rope axis.

2. The method of claim 1 further characterized in that said core is wrapped with one or more tapes in opposite directions, there being the same number of tapes in each direction.

3. The method of claim 1 further comprising the steps of applying an outer cover to said wrapped core.

4. The method of claim 3 further characterized in that said outer cover is a braided sheath.

5. The method of claim 4 further comprising the step of impregnating said braided sheath with a curable plastic material.

6. A method of making rope or cable comprising the steps of:

(a) aligning and compacting a plurality of filaments under tension to form a core;

(b) spirally wrapping said core with one or more tapes so as to completely cover said core; and (c) applying an outer cover to said wrapped core, said outer cover comprising a curable plastic material that impregnates said wrap but not said core.

7. The method of claim 6 further characterized in that said outer cover further comprises a braided sheath over said plastic material.

8. The method of claim 7 further comprising the step of impregnating said braided sheath with a curable plastic material.

9. The method of claim 6 further characterized in that said plastic material provides a coating over said wrapped core.

10. The method of claim 6 further characterized in that said tapes consist of absorbent ribbons.

11. A method of making rope or cable comprising the steps of:

(a) aligning a plurality of filaments to form a core;
(b) passing the core through a first sizing die to compact the filaments and exert back-tension thereon;
(c) spirally wrapping said compacted core with one or more tapes so as to completely cover said core;
(d) passing the wrapped core through a second sizing die and forcing a curable plastic material into said wrap, but not into the core;
(e) removing any excess coating of plastic material from the outer surface of said wrap; and
(f) passing the wrapped core through a curing zone to cure the plastic material.

12. The method of claim 11 further characterized in that said core is wrapped with one or more tapes in opposite directions, there being the same number of tapes in each direction.

13. The method of claim 11 further characterized in that after step (f) a braided sheath is applied over said wrapped core.

14. The method of claim 11 further characterized in that said tapes consist of absorbent ribbons.

15. The method of claim 11 further characterized in that during the performance of step (e), a thin layer of plastic material is left surrounding the wrap to improve moisture and abrasion resistance.

16. The method of claim 13 further comprising the step of impregnating said braided sheath with a curable plastic material.

17. A rope or cable comprising:

(a) a core having a multiplicity of compacted tensioned filaments aligned in substantially parallel relation to each other and to the rope axis, said filaments being independent of each other; and
(b) a jacket around said core comprising one or more tapes helically wound around said core so as to completely cover same.

18. The rope of claim 17 further characterized in that said core is wrapped with one or more tapes in opposite directions, there being the same number of tapes in each direction.

19. The rope of claim 17 further comprising an outer cover surrounding said wrapped core.

20. A rope or cable comprising:

(a) a core of aligned, compacted, parallel filaments, each independent of the others;
(b) a jacket around said core comprising one or more tapes helically wound around said core so as to completely cover same; and
(c) an outer cover surrounding said wrapped core, said outer cover comprising a cured plastic material that impregnates said wrap but not said core.

21. The rope of claim 20, said plastic material being a polyurethane polymer.

22. The rope of claim 20, said outer cover further comprising a braided sheath over said plastic-impregnated wrap.

23. The rope of claim 22 further characterized in that said braided sheath is impregnated with a cured plastic material.

24. The rope of claim 20 further characterized in that said tapes consist of absorbent ribbons.

25. The rope of claim 19, said outer cover comprising a braided sheath.

26. The rope of claim 25 further characterized in that said braided sheath is impregnated with a cured plastic material.

27. The rope of claim 17, said core filaments being polyester monofilaments.

28. The rope of claim 20 further comprising a layer of said cured plastic material surrounding said wrap in order to improve the rope's abrasion and moisture resistance.

* * * * *